US006698144B1

(12) United States Patent
Larson

(10) Patent No.: US 6,698,144 B1
(45) Date of Patent: Mar. 2, 2004

(54) STUCCO CASING BEAD

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 10/126,228

(22) Filed: Apr. 18, 2002

(51) Int. Cl.[7] ..... E04F 13/04; E04B 1/00; E04B 1/70; E04B 9/00; E06B 3/26

(52) U.S. Cl. ..... 52/202; 52/254; 52/255; 52/302.6; 52/344; 52/443

(58) Field of Search ..... 52/254, 255, 256, 52/257, 302.1, 302.6, 235, 169.5, 344, 101, 443, 449, 349, 202

(56) References Cited

U.S. PATENT DOCUMENTS 3,204,382 A * 9/1965 McGurn ..... 52/349
3,672,108 A * 6/1972 Conway ..... 52/367
5,410,852 A * 5/1995 Edgar et al. ..... 52/408
5,442,886 A * 8/1995 Iacobelli ..... 52/255
5,839,241 A * 11/1998 Cacossa et al. ..... 52/255
5,937,600 A * 8/1999 Larson ..... 52/302.6
5,946,870 A * 9/1999 Bifano et al. ..... 52/254
5,970,671 A * 10/1999 Bifano et al. ..... 52/254
6,298,609 B1 * 10/2001 Bifano et al. ..... 52/58
6,410,118 B1 * 6/2002 Reicherts et al. ..... 428/141
6,470,638 B1 * 10/2002 Larson ..... 52/302.1

* cited by examiner

*Primary Examiner*—Brian E. Glessner
*Assistant Examiner*—Kevin McDermott

(57) ABSTRACT

An improved curtain wall casing bead for installation on buildings having stucco or similar curtain wall exteriors. The improved curtain wall casing bead incorporates a mesh attached to at least the front wall of the casing or starter bead, which mesh extends beyond the height of the front wall and provides additional area for the infiltration of over-applied stucco finishes or the like. Such additional infiltration, after drying of the over-applied layer provides a more adherent, higher quality and more durable attachment of the stucco finish to the casing bead and the overall wall structure is achieved.

2 Claims, 2 Drawing Sheets

STUCCO CASING BEAD

The present invention relates to an improved casing bead for the installation of exterior curtain wall or stucco siding and the like and more particularly to such a casing bead that incorporates an attached mesh structure for more secure installation and application of over-applied stucco finishes.

BACKGROUND OF THE INVENTION

The term curtain wall refers to a type of building construction in which an exterior non-load-bearing wall is supported in front of the structural frame like a curtain. U.S. Pat. No. 5,937,600 describes a casing bead or starter track for the installation of stucco-covered, curtain wall type, foamed siding applied to the exterior of buildings prior to the application of an over-applied coating of a stucco finish or the like. The device described in this patent comprises a generally U-shaped channel and incorporates in its front wall apertures for the infiltration of caulk, stucco or the like during erection and in its rear wall striations that serve to grip an inserted foam panel and any included caulking or the like.

While the casing bead as just described offers enhanced resistance to moisture infiltration as well as security of installation, there remains a continuing desire to improve the adhesion of the over-applied stucco finish to the casing or starter bead as described in this U.S. Patent. Thus, while infiltration of the over-applied stucco into the apertures in the front wall of the prior art casing bead channel provides some adhesion of the over-applied stucco finish, it would be highly desirable if some means could be provided to further improve the adhesion of the over-applied stucco finish to the casing or starter bead to improve the overall quality and durability of the installation.

OBJECT OF THE INVENTION

It is therefore an object of the present invention to provide an improved casing bead for installation on buildings utilizing a stucco-covered, curtain wall-type construction that demonstrates provides a mechanism for improving the adhesion of an over-applied stucco finish or the like.

SUMMARY OF THE INVENTION

According to the present invention, there is provided an improved casing or starter bead structure for the installation of curtain wall structures of the type described above. This improved casing or starter bead incorporates a mesh attached to at least the front wall of the casing or starter bead, which mesh extends beyond the height of the front wall and provides additional area for the infiltration of over-applied stucco finishes or the like. Such additional infiltration, after drying of the over-applied layer provides a more adherent, higher quality and more durable attachment of the stucco finish to the casing bead and the overall wall structure.

DETAILED DESCRIPTION

Figure 1:
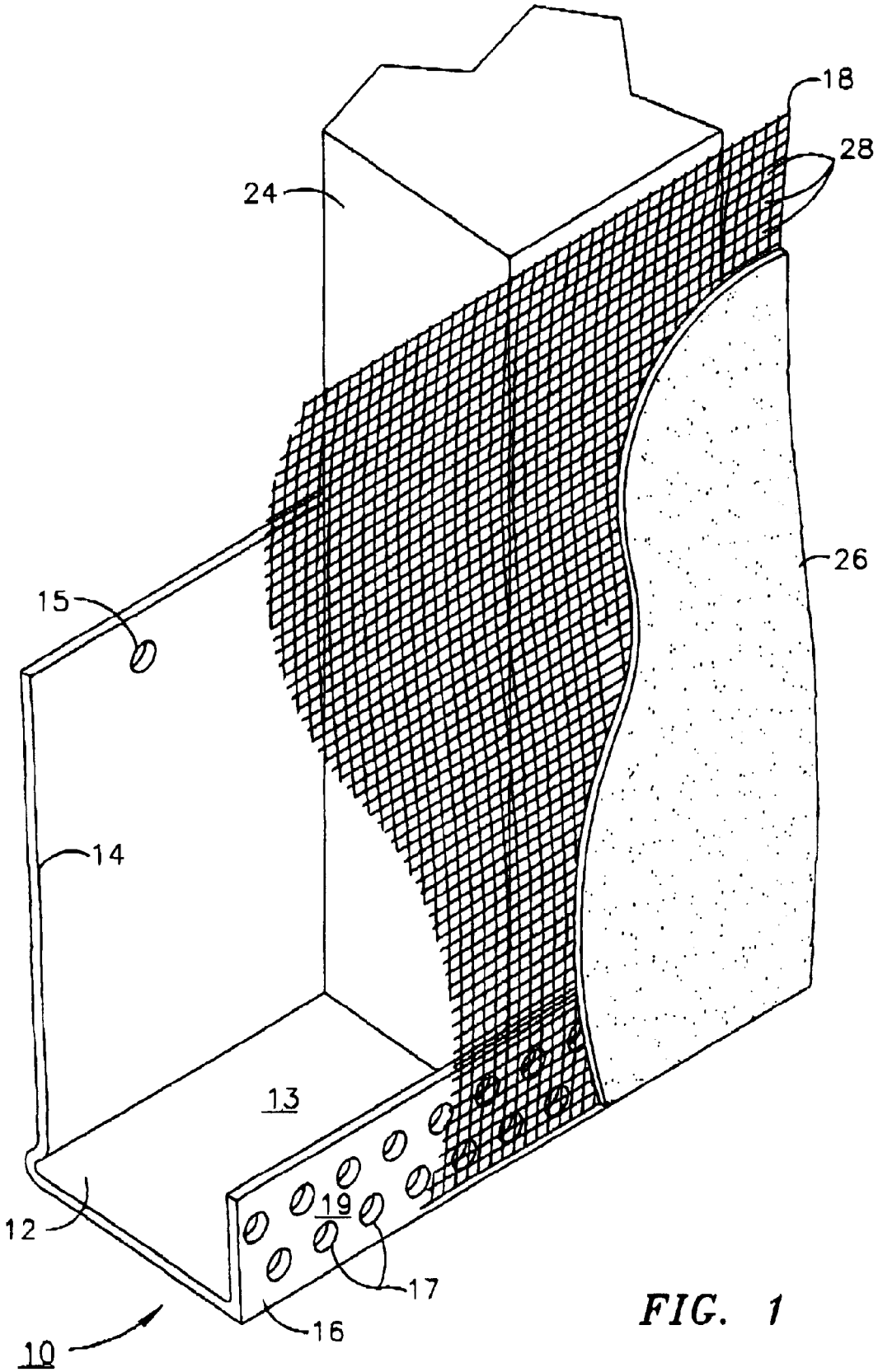
FIG. 1 is a partially cutaway perspective view of the improved casing bead of the present invention.

As shown in FIG. 1, the casing bead 10 of the present invention comprises a relatively horizontal base 12, an elongated upright nailing flange 14 extending vertically from upper surface 13 of horizontal base 12 at an angle of b 90° or more and preferably about 95°, an upright elongated front flange 16 extending upward generally parallel to nailing flange 14 and a mesh 18, incorporating openings 28, that is attached to the front or outer surface 19 of front flange 16. Upright front flange 16 preferably incorporates apertures 17 that permit infiltration of an over-applied stucco or similar finish as seen most clearly in FIG. 2 described below. According to a preferred embodiment, mesh 18 is wrapped about the outside surfaces 21 and 21A of horizontal base 12 and upright nailing flange 14 respectively. Other arrangements such as simple attachment solely to outside surface 19 of front flange 16, or attachment to front flange outside surface 19 and base lower surface 21 are also considered acceptable as long as secure attachment of mesh 18 to the structural member(s) of casing bead 10 is achieved. Nailing flange 14 incorporates apertures 15 for insertion of fasteners such as nails 23 to attach casing bead 10 to a wall 22 (see FIG. 2).

Mesh 18 may be fabricated from any suitable material such as a polymeric filament, fiberglass etc. or any other suitable material which can be made to adhere or otherwise be attached to the structural surfaces (outside surfaces 19, 21 and 21A) of casing bead 10 to allow secure attachment of stucco or other suitable finish 26 thereto through infiltration of finish 26 through openings 28. According to a specifically preferred embodiment, mesh 18 is fabricated from fiberglass for reasons of cost, availability and strength relative thereto.

The size of openings 28 in mesh 18 is not particularly critical to the successful practice of the present invention, as long as openings 28 are of a size and configuration as to provide adequate improved adhesion of over-applied finish 26 as described herein. A preferred size for openings 28 is about one eighth inch square as this size is easily obtained and provides the required adhesion of finish 26 to curtain wall casing bead 10.

Mesh 18 may be attached to casing bead 10 in any suitable fashion including but not limited to adhesion using an appropriate adhesive, double sided tape, strippable adhesive tape or using more sophisticated techniques such as welding, ultrasonically or otherwise, of mesh 18 to outside surfaces 19, 21 and 21A. Whatever method is used to attach mesh 18 to the structure of casing bead 10, it should be adequate to provide a relatively strong attachment to provide the enhanced bonding quality and durability desired through the use of this unique and novel structure in a curtain wall installation.

Casing bead 10 may be fabricated from any suitable material such as a metal or plastic, however plastic materials such as poly(vinyl)chloride and the like are specifically preferred for reasons of cost and ease of manufacture through extrusion.

Figure 2:
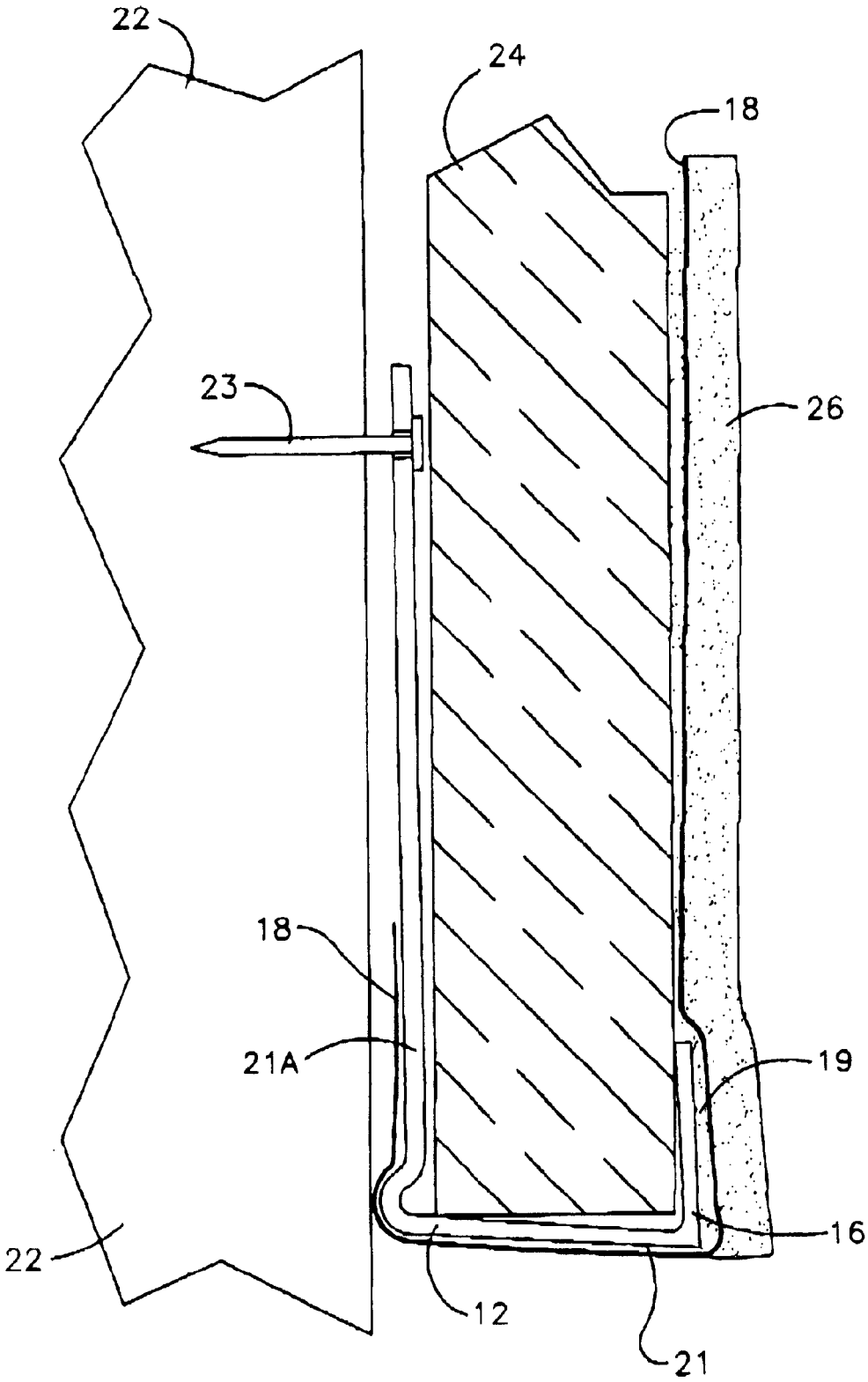
FIG. 2 is a cross-sectional view of the stucco casing bead of the present invention showing the relationship between the wall, the inserted foam, the over-applied stucco finish and the casing bead of the present invention.

FIG. 2 shows casing bead 10 applied to a wall 22 using nails or similar fasteners 23 and including mesh 18, an inserted foamed panel 24 and over-applied stucco or similar finish 26. Apertures 17 allow infiltration of stucco or similar finish 26 into upright front wall 16. Similarly, stucco or similar finish 26 infiltrates the openings 28 in mesh 18 allowing stucco or similar finish. 26 to adhere to foam panel 24 through the various apertures 17 and openings 28 to firmly secure stucco finish 26 to foam panel 24 and in turn to casing bead 10 after finish 26 sets or hardens, thereby providing a virtually monolithic or at least unitized curtain wall structure.

While it is preferred that mesh 18 be co-extensive, i.e. extend along the entire length of front flange 16, it is, of course, possible to obtain some of the advantages of the use of the structure described herein by locating segments of mesh 18 intermittently along front flange 16, at either end of a section front flange 16 or in any other of numerous possible configurations, and all of such alternative configurations are considered to be within the scope of the preferred embodiments of the present invention.

In the prior art casing beads of the type described herein, nailing flange 14 has been relatively short, i.e. less than about 2 inches. This made nailing of the casing bead in place relatively difficult and, while providing adequate protection against moisture permeation due to "blow back" of rain at the junction of the casing bead and the over-applied stucco, in some more aggravated cases, moisture could and did pass over the top of the nailing flange. The casing bead 10 of the present invention utilizes a nailing flange 14 that is between about 3 and 4 inches high and preferably at least 3.5 inches high to simplify the nailing task and to provide added protection against moisture penetration in high wind situations.

Base 12 may be of any appropriate width, but should be such as to engage the foam panel 24 being installed therein. Such materials generally have a thickness of between about ½ of an inch and 1 inch and the width of base 12 between nailing flange 14 and upright front flange 16 should be such as to accommodate such materials of these dimensions.

As will be apparent to the skilled artisan, a number of variations and modifications can be made to the structure described above without departing from the spirit and scope of the present invention. All sucb modifications and variations are clearly contemplated as being within the scope of the appended claims.

What is claimed is:

1. A curtain wall casing bead comprising:

a) a base having front and rear elongated edges and upper and lower surfaces;

b) a nailing flange extending upward from said base along said rear elongated edge at an angle greater than about 90° and including an outside surface;

c) an upright elongated front flange extending upward from said base approximately parallel to said nailing flange along said front elongated edge and including an outside surface; and d) a mesh including openings therein attached to said upright elongated front flange outside surface and said base lower surface, said mesh extending upward from said base beyond said upright elongated flange.

2. A curtain wall casing bead comprising:

a) a base having front and rear elongated edges and upper and lower surfaces;

b) a nailing flange extending upward from said base along said rear elongated edge at an angle greater than about 90° and including an outside surface;

c) an upright elongated front flange extending upward from said base approximately parallel to said nailing flange along said front elongated edge and including an outside surface; and d) a mesh including openings therein attached to said upright elongated front flange outside surface, said base lower surface and said nailing flange outside surface, said mesh extending upward from said base beyond said upright elongated flange.

* * * * *